US006990899B2

(12) United States Patent
Kato

(10) Patent No.: US 6,990,899 B2
(45) Date of Patent: Jan. 31, 2006

(54) STENCIL PRINTING MACHINE

(75) Inventor: Kazuhiro Kato, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/830,234

(22) Filed: Apr. 23, 2004

(65) Prior Publication Data

US 2004/0221752 A1 Nov. 11, 2004

(30) Foreign Application Priority Data

May 7, 2003 (JP) ..... P2003-128845

(51) Int. Cl.
*B41L 13/14* (2006.01)

(52) U.S. Cl. ..... 101/117; 101/116

(58) Field of Classification Search ..... 101/116–118, 101/121, 477, 128.4, 128.21
See application file for complete search history.

(56) References Cited

U.S. PATENT DOCUMENTS 5,623,871 A * 4/1997 Takahira ..... 101/114
5,673,619 A * 10/1997 Ohinata et al. ..... 101/116
5,713,279 A * 2/1998 Iida et al. ..... 101/128.4
5,953,985 A * 9/1999 Kobayashi ..... 101/116
6,076,460 A * 6/2000 Kagawa ..... 101/128.4
6,263,791 B1 * 7/2001 Sato ..... 101/116
6,283,020 B1 * 9/2001 Ohno ..... 101/116
6,499,394 B1 * 12/2002 Kawagoe et al. ..... 101/128.1
6,832,831 B2 * 12/2004 Shima et al. ..... 347/102
6,886,457 B2 * 5/2005 Shoji ..... 101/128.4
2001/0025582 A1 * 10/2001 Furutsuka ..... 101/477
2002/0053291 A1 * 5/2002 Kidoura et al. ..... 101/116
2002/0078337 A1 * 6/2002 Hashimoto ..... 101/116

FOREIGN PATENT DOCUMENTS

JP 09-011600 1/1997

* cited by examiner

*Primary Examiner*—Anthony H. Nguyen
(74) *Attorney, Agent, or Firm*—Nath & Associates PLLC; Gregory B. Kang; Derek Richmond

(57) ABSTRACT

A conveying route along which the leading edge side of a roll stencil sheet is conveyed to a stencil sheet clamp section of a printing drum is formed. Along the conveying route, arranged are: a writing head which forms a perforated image on the stencil sheet; a platen roller on which the writing head is brought into pressure contact and which conveys the stencil sheet; a stencil sheet cutter which cuts the stencil sheet; a stencil positioning sensor which detects a leading edge of the stencil sheet; and storage means for temporarily storing the stencil sheet. Control means for controlling a timing with which the printing drum is rotated to start loading of the stencil sheet is included, the control means controlling the timing to be an arbitrary time between an earliest timing earlier, by a time period obtained by dividing a conveying distance between the stencil sheet cutter and the stencil sheet clamp section by a peripheral speed of the platen roller, than a timing with which the writing head completes forming a perforated image on the stencil sheet and a latest timing which is a same timing as completion of release of stencil making pressure.

2 Claims, 6 Drawing Sheets

STENCIL PRINTING MACHINE

BACKGROUND OF THE INVENTION

1. Field of the Invention

The present invention relates to a stencil printing machine which creates a printed sheet by forming a perforated image on a stencil sheet based on image data and transferring ink to a print medium through this perforated image on the stencil sheet. Specifically, the present invention relates to a technology for shortening a first print time to form the perforated image and output a first trial print.

2. Description of the Related Art

A conventional stencil printing machine is described in Japanese Patent Laid-Open publication No. Hei 9(1997)-11600. FIG. 1 is a schematic drawing showing main parts of the stencil printing machine described in the publication, the parts being related to stencil making and loading. In FIG. 1, a rolled stencil sheet 2, a writing head 8, a platen roller 7, a pair of first conveyer rollers 12*a* and 12*b*, a storage box 13, a pair of second conveyer rollers 14*a* and 14*b*, a stencil sheet cutter 10, a stencil positioning sensor 17, a printing drum 4, and a stencil sheet clamp section 4*a* are arranged along a conveyance route R1. The drawing shows a case where the stencil sheet clamp section 4*a* is placed at a clamp rotational position where the stencil sheet 2 is clamped, and the writing head 8 is placed at a standby position.

In FIG. 1, the leading edge of the stencil sheet 2 cut with the stencil sheet cutter 10 in the last stencil loading operation is conveyed downstream along the conveying route R1 by the platen roller 7 which is rotated by a platen motor (not shown). At this time, by a head shift driver (not shown), the writing head 8 is located at a pressure contact position where the writing head 8 is in pressure contact with the platen roller 7.

When the stencil positioning sensor 17 detects the leading edge of the stencil sheet 2, a timer (not shown) starts clocking. After a predetermined time period, the platen roller 7 stops rotation, and the leading edge of the stencil sheet 2 stops at a predetermined position (a waiting position) on the conveying route R1. The writing head 8 is then shifted to the standby position, and the leading edge of the stencil sheet 2 stays at the waiting position until the next stencil loading operation starts.

The stencil making and loading operations of the conventional stencil printing machine have been performed according to a procedure as described below.

The stencil making operation is performed in the following manner. The writing head 8 is located at the pressure contact position, and the stencil sheet 2 is subjected to writing (thermal perforation) according to binarized data for stencil making while the stencil sheet 2 sandwiched between the writing head 8 and the platen roller 7 is being conveyed. At this time, the rotation of the second conveyer rollers. 14*a* and 14*b* is stopped, the perforated stencil sheet 2 stays between the first conveyer rollers 12*a* and 12*b* and the second conveyer rollers 14*a* and 14*b*, and is gradually stored in the storage box 13.

A stencil making time period for the stencil sheet 2 which corresponds to a conveying distance L1 between the waiting position of the leading edge of the stencil sheet 2 and the stencil sheet clamp section 4*a* along the conveying route R1 is measured by a timer or the like as a driving time period of the platen motor 20. When the stencil making time period elapsed after the stencil making is started, the second conveyer rollers 14*a* and 14*b* are rotated, and the leading edge of the stencil sheet 2 is conveyed to the stencil sheet clamp section 4*a*. The rotation of the second conveyer rollers 14*a* and 14*b* is then stopped.

When the rotation of the second conveyer rollers 14*a* and 14*b* is stopped, the perforated stencil sheet 2 is gradually stored in the storage box 13 again. Meanwhile, a writing operation for the stencil sheet 2 by the platen roller 7 and the writing head 8 is continued while the stencil sheet 2 is being conveyed by the second conveyer rollers 14*a* and 14*b*.

When the writing operation is completed, the writing head 8 is shifted by the head shift driver (not shown) from the pressure contact position to the standby position away from the platen roller 7 by a predetermined distance. This shifting operation of the writing head 8 is called a stencil making pressure release, and the time period required for release of stencil making pressure is defined as a stencil making pressure release time period T.

After the stencil making pressure is released, the printing drum 4 is driven to an angle which is equivalent to a stencil loading length {L−(L1+L2)} from the clamp rotational position by a rotor (not shown), and the stencil sheet 2 is loaded on the printing drum 4. Thereafter, the rotation of the printing drum 4 is once stopped, and the stencil sheet 2 is cut with the stencil sheet cutter 10. A time period required for the cutting is defined as a cutting time period Tk. Herein, L1 is the stencil loading length of the printing drum 4 and L2 is a conveying distance from the stencil sheet cutter 10 to the waiting position of the leading edge of the stencil sheet 2 along the conveying route R1.

Subsequently, the printing drum 4 is rotated again, and part of the stencil sheet 2 with a length of (L1+L2) remaining on the conveying route R1 is loaded thereon. When the stencil sheet clamp section 4*a* returns to the clamp rotational position, the rotation of the printing drum 4 is stopped. If the stencil positioning sensor 17 does not detect the stencil sheet 2, the stencil loading operation is completed. The writing head 8 is then shifted to the pressure contact position, and the platen roller 7 is rotated. The leading edge of the cut stencil sheet 2 is thus conveyed downstream on the conveying route R1. When the stencil positioning sensor 17 detects the leading edge of the stencil sheet 2, the timer (not shown) starts clocking. The drive of the platen motor 20 is stopped after the predetermined time period, and the rotation of the platen roller 7 is stopped. The leading edge of the stencil sheet 2 stops at the predetermined position (the waiting position) on the conveying route R1.

FIG. 6A shows a time chart related to the aforementioned stencil making (writing), stencil making pressure release, conveying (rotation of platen roller) stencil loading (rotation of printing drum), cutting, and printing/printed sheet discharged operations.

A stencil making operation time period Ts is expressed as Ts=(L−L3)/Sp. Herein, Sp is a peripheral speed of the platen roller 7. Note that L3 is a length (hereinafter, referred to as a margin length) of the stencil sheet 2 corresponding to a margin of the trailing end in the sheet conveying direction in which writing (printing) is not allowed.

The time period required for the stencil making pressure release operation is the stencil making pressure release time period T.

A stencil loading operation time period Tc is the total of a stencil loading time period for loading the stencil sheet 2 with a length of L and the cutting time period Tk of the stencil sheet 2, and is expressed as Tc=L/Sh+Tk. During the stencil sheet loading operation, the printing drum 4 is rotated to load part of the stencil sheet 2 with a length of {L−(L1+L2)} thereon at first. After the cutting time period Tk during which the rotation is being stopped, the printing drum 4 is rotated again to load part of the stencil sheet 2 with a length of (L1+L2) thereon.

Specifically, the length {L−(L1+L2)} of the stencil sheet 2 is expressed as {L−(L1+L2+L3)}+L3}, where L3 is the length of part of the stencil sheet 2 conveyed by the printing drum 4 which is rotated after the stencil making pressure release, and (L1+L2) is the length of the part of the stencil sheet 2 remaining on the conveying route R1 when the stencil sheet 2 is cut with the stencil sheet cutter 10. Herein, Sh is a peripheral speed of the printing drum 4 during the stencil loading.

As for the cutting time period Tk, an example of a shuttle cutter, which cuts the stencil sheet 2 while the stencil sheet 2 is being stopped, is shown according to a later described embodiment. However, the cutting time period Tk can be made to be 0 by using a rotary cutter.

Accordingly, the stencil loading operation time period Tc is expressed as Tc=L/Sh+Tk {L−(L1+L2+L3)+L3}/Sh+Tk+(L1+L2)/Sh.

Consequently, a first print time Tf1 is expressed as Tf1=Ts+T+Tc+Tp, where Tp is a time period for the printing/printed sheet discharged operation.

As described above, in the conventional stencil printing machine, there has been a disadvantage that the first print time is long because of serial processing of the stencil making, stencil making pressure release, stencil loading, cutting, and printing/printed sheet discharged operations.

SUMMARY OF THE INVENTION

The present invention has been made in the light of the aforementioned problem, and an object thereof is to provide a stencil printing machine capable of reduction in a first print time only by changing a process sequence without modification of hardware of the stencil printing machine such as modification of the mechanical mechanism and addition of mechanism.

In order to achieve the above object, a stencil printing machine according to the present invention includes: a conveying route along which a leading edge side of a roll stencil sheet is conveyed to a stencil sheet clamp section of a printing drum; a writing head which forms a perforated image on the stencil sheet; a platen roller on which the writing head is brought into pressure contact and which conveys the stencil sheet; a stencil sheet cutter which cuts the stencil sheet; a stencil positioning sensor which detects a leading edge of the stencil sheet; storage means for temporarily storing the stencil sheet; and control means for controlling a timing with which the printing drum is rotated to start loading of the stencil sheet, the control means controlling the timing to be an arbitrary time between an earliest timing earlier, by a time period obtained by dividing a conveying distance (L1+L2) between the stencil sheet cutter and the stencil sheet clamp section by a peripheral speed (Sp) of the platen roller, than a timing with which the writing head completes forming a perforated image on the stencil sheet and a latest timing which is the same timing as completion of release of stencil making pressure.

As described above, the timing with which the printing drum is rotated to start loading of the stencil sheet is controlled to be an arbitrary time between the earliest timing earlier, by a time period obtained by dividing a conveying distance (L1+L2) between the stencil sheet cutter and the stencil sheet clamp section by a peripheral speed (Sp) of the platen roller, than a timing with which the writing head completes a stencil making operation and a latest timing which is the same timing as that with which the writing head completes forming a perforated image on the stencil sheet. Here, the earliest timing is a timing of releasing the printing pressure and it is a same time that there is no sheet stored in the storage means. Thus, the timing of completing the stencil loading operation is made earlier by a time period ranging from T+(L1+L2)/Sp at the maximum to zero at the minimum, and the first print time can be shortened by the above time period.

Furthermore, the control means may control the timing with which the printing drum is rotated to start loading of the stencil sheet such that the timing is a same timing as the timing with which the writing head completes forming a perforated image on the stencil sheet.

In particular, by controlling the timing such that the writing head starts stencil loading at the same timing as completion of formation of a perforated image on the stencil sheet, the first print time can be shortened by the stencil making pressure release time period T. Moreover, the control operation can be simplified.

DETAILED DESCRIPTION OF THE PREFERRED EMBODIMENT

Hereinafter, a description will be given of an embodiment of the present invention with reference to the drawings.

Figure 1:
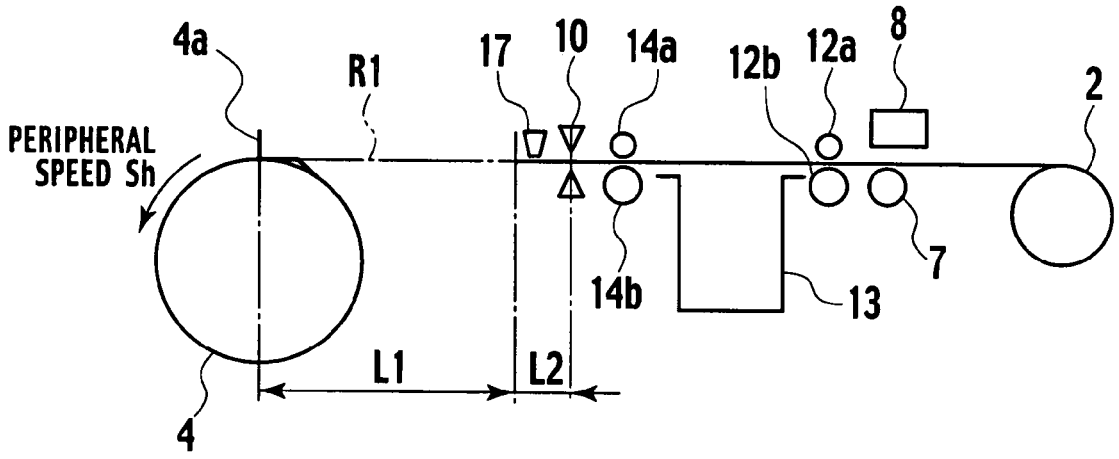
FIG. 1 PRIOR ART
FIG. 1 is a schematic drawing of a stencil making unit of a stencil printing machine showing a conventional embodiment.
Figure 2:
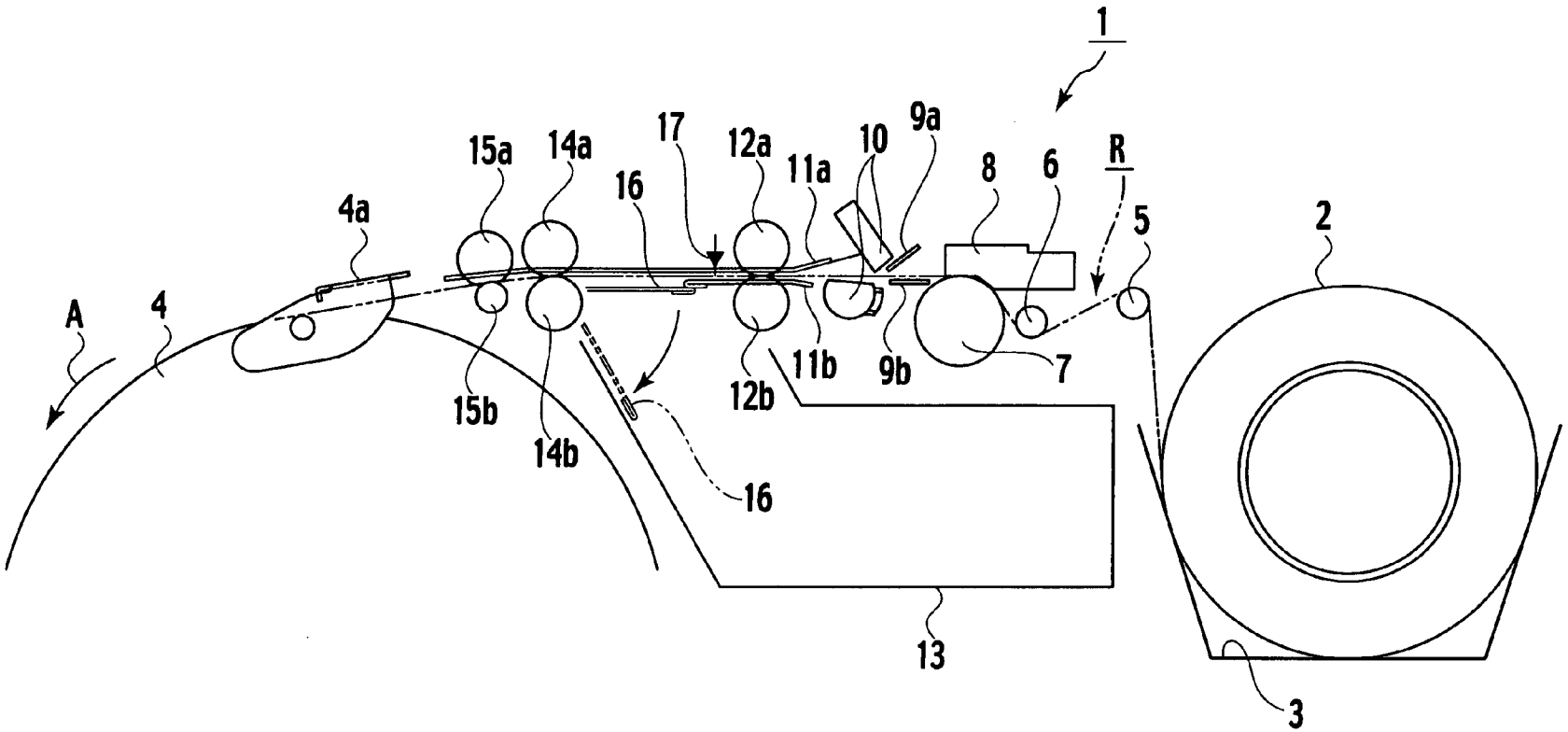
FIG. 2 is a schematic drawing of a stencil making unit of a stencil printing machine showing an embodiment of the present invention.
Figure 3:
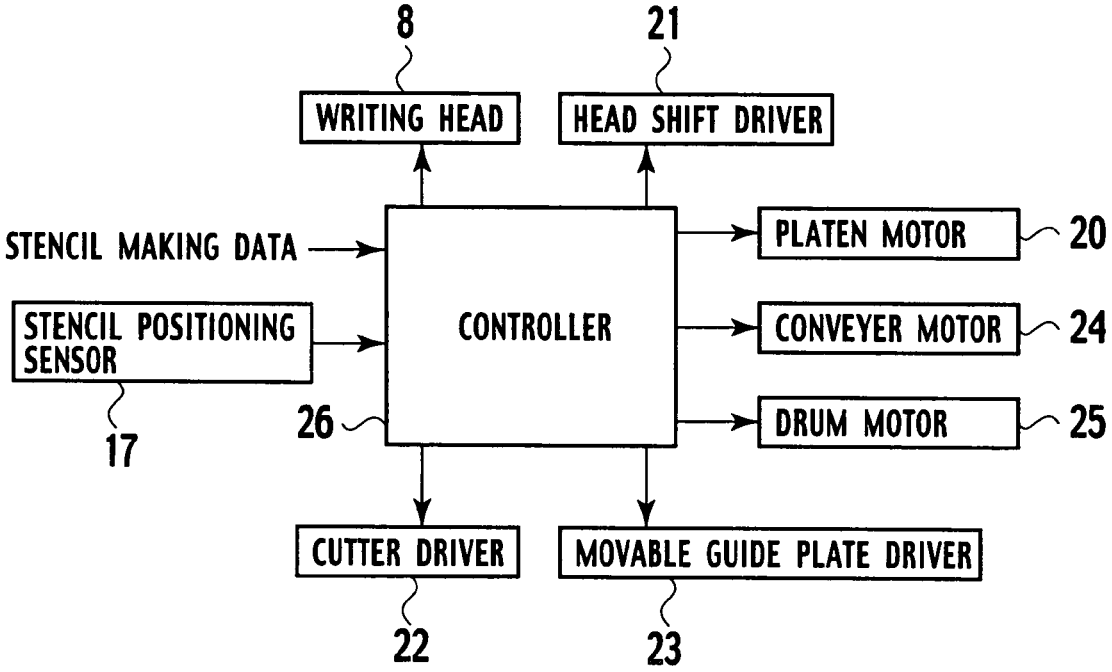
FIG. 3 is a block diagram related to the stencil making unit of the stencil printing machine showing the embodiment of the present invention.
Figure 4A:
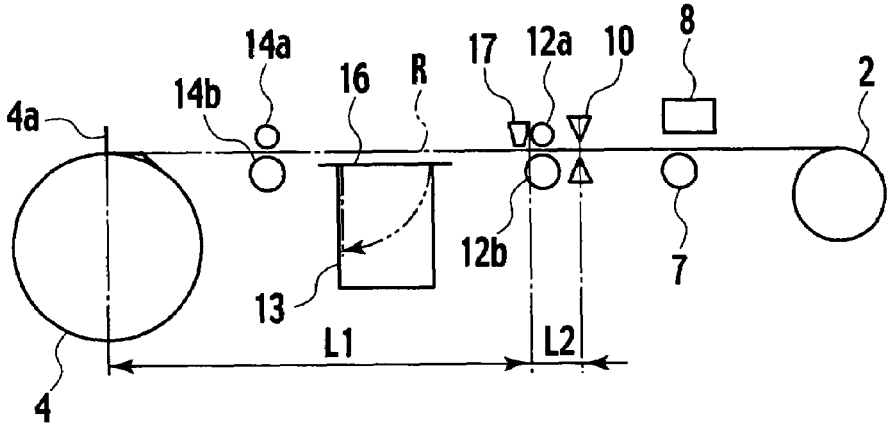
FIGS. 4A to 4C are schematic drawings explaining a stencil loading operation of the stencil printing machine showing the embodiment of the present invention.
Figure 4B:
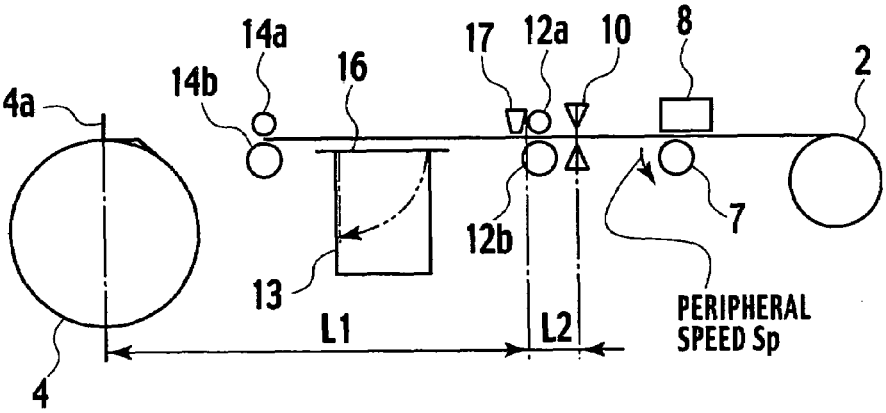
Figure 4C:
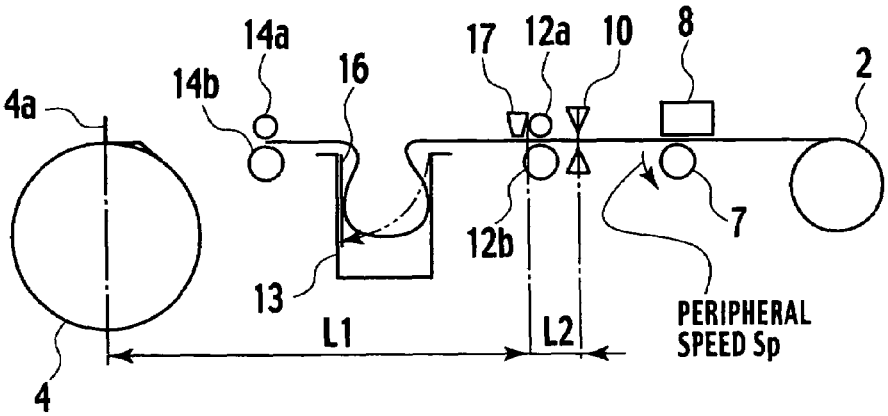
Figure 5A:
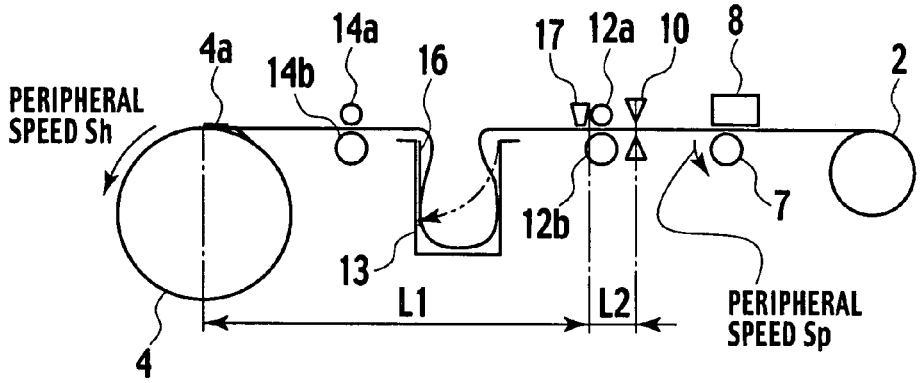
FIGS. 5A to 5C are schematic drawings explaining the stencil loading operation of the stencil printing machine showing the embodiment of the present invention.
Figure 5B:
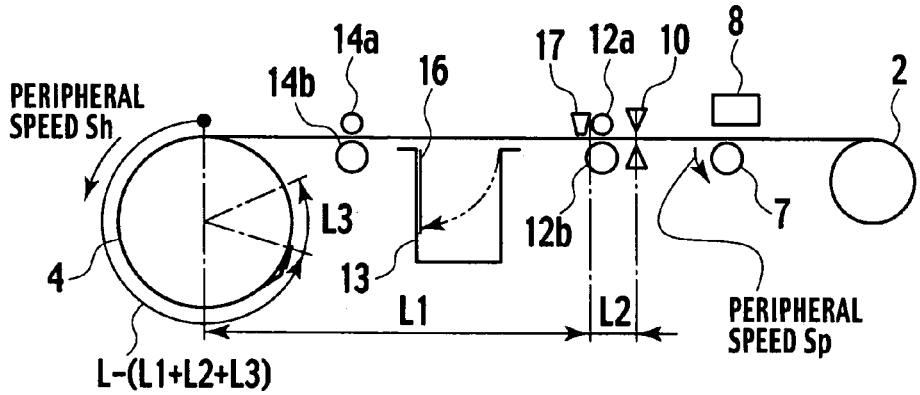
Figure 5C:
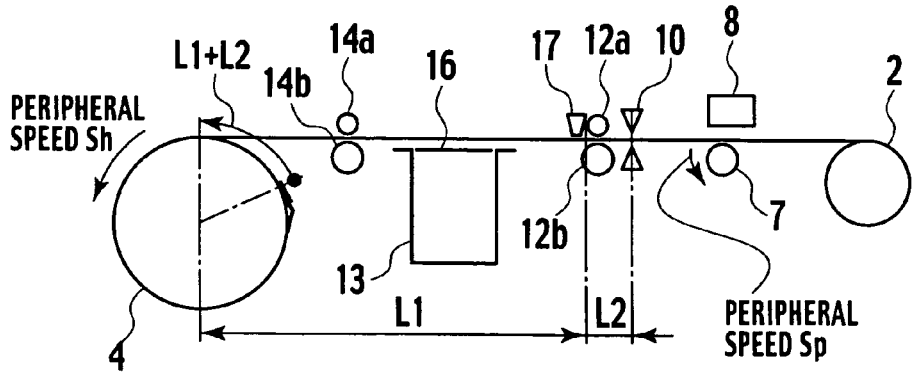
Figure 6A:
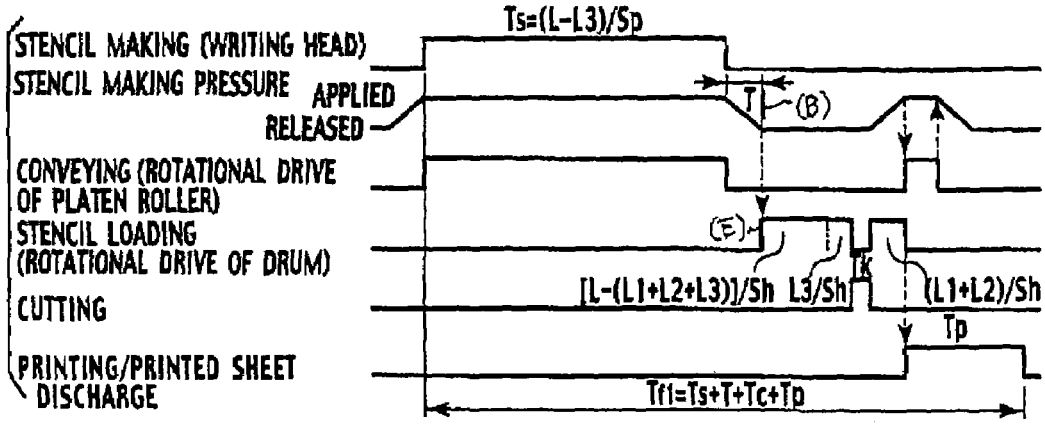
FIGS. 6A to 6C are time charts related to a first print time of the stencil printing machine showing the embodiment of the present invention.
Figure 6B:
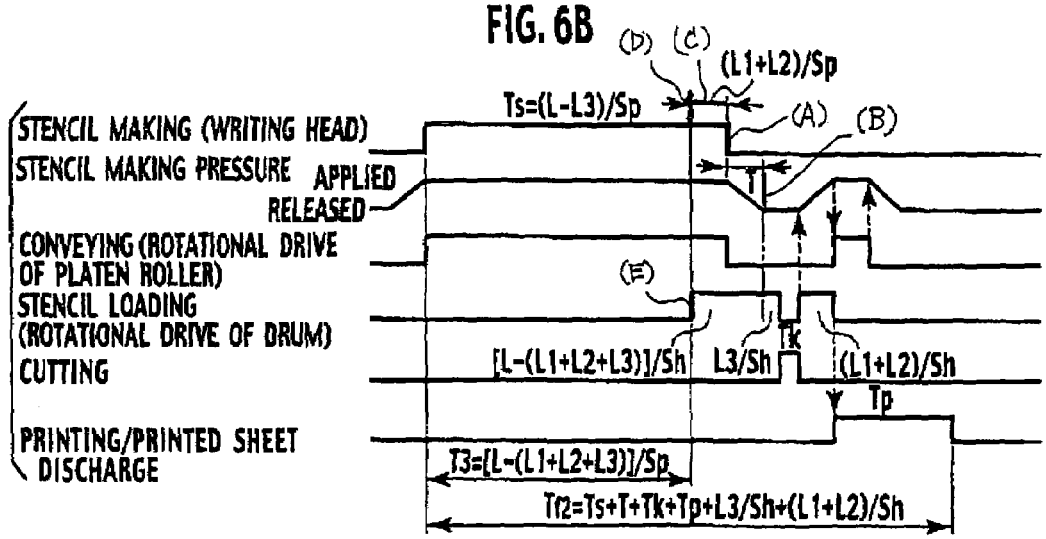
Figure 6C:
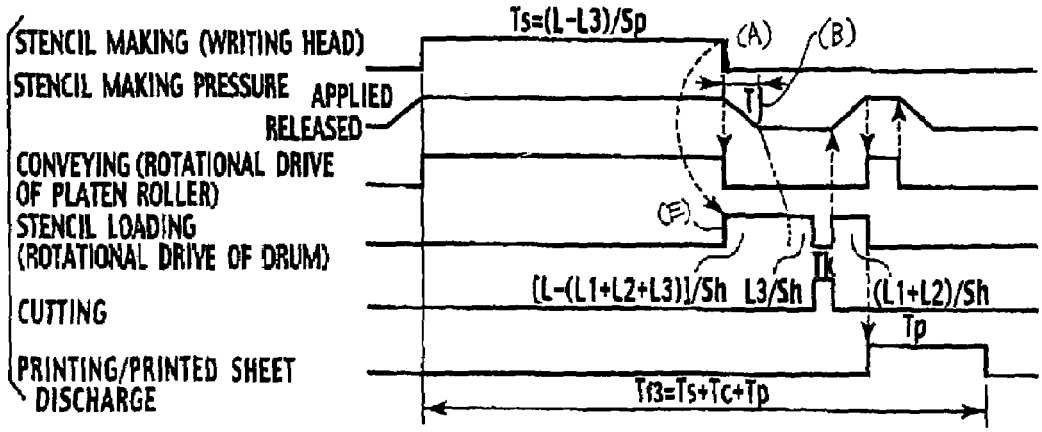

FIG. 2 to FIG. 6C show an embodiment of the present invention. FIG. 2 is a schematic drawing of a stencil making unit of a stencil printing machine according to the present invention, FIG. 3 is a block diagram of main parts related to the stencil making unit and the like of the stencil printing machine, FIGS. 4A to 4C and FIGS. 5A to 5C are schematic views explaining a stencil loading operation, and FIGS. 6A to 6C are time charts related to a first print time.

As shown in FIG. 2, a stencil making unit 1 includes a stencil sheet roll container 3 which accommodates a roll stencil sheet 2. A conveying route R (indicated by a chain double-dashed line in FIG. 2) is formed between the stencil sheet roll container 3 and a stencil sheet clamp section 4*a* of a printing drum 4.

The conveying route R includes: a first guide roller 5 placed just downstream of the stencil sheet accommodating unit 3; a second guide roller 6 placed downstream of the first guide roller 5; a platen roller 7 and a writing head 8 placed just downstream of the second guide roller 6; a pair of first guide members 9*a* and 9*b* placed downstream of the platen roller 7 and the writing head 8; a pair of second guide members 11*a* and 11*b* placed downstream of the pair of first guide members 9*a* and 9*b* as well as downstream of a stencil sheet cutter 10; a pair of first conveyer rollers 12*a* and 12*b* placed in a guide zone of the pair of second guide members 11*a* and 11*b*; a pair of second conveyer rollers 14*a* and 14*b* placed downstream of the pair of first conveyer rollers 12*a* and 12*b* as well as downstream of a storage box 13; and a pair of third conveyer rollers 15*a* and 15*b* placed downstream of the pair of second conveyer rollers 14*a* and 14*b*.

The platen roller 7 is to be rotated by the driving force of a platen motor 20 (shown in FIG. 3).

The first conveyer roller 12*b* is rotated in synchronization with the platen roller 7 by the driving force of the platen motor 20. The pair of first conveyer rollers 12*a* and 12*b* has weaker rotating force as compared with the platen roller 7 and the writing head 8, and the peripheral speed thereof is set higher. In other words, the speed at which the platen roller 7 conveys the stencil sheet 2 depends on a peripheral speed Sp of the platen roller 7 during the stencil making.

The writing head 8 is, for example, a thermal print head which forms a perforated image by thermally perforating the stencil sheet 2 at desired points. The writing head 8 is to be shifted by a head shift driver 21 (shown in FIG. 3) between a pressure contact position (position in FIG. 2) where the writing head 8 is in pressure contact with the platen roller 7 and a standby position spaced from the platen roller 7.

The stencil sheet cutter 10 is placed between the pair of first guide members 9*a* and 9*b* and the pair of second guide members 11*a* and 11*b* and cuts the stencil sheet 2 by drive of a cutter driver 22 (shown in FIG. 3).

The storage box 13, which is a space for storing the stencil sheet 2, is placed between the pair of first conveyer rollers 12*a* and 12*b* and the pair of second conveyer rollers 14*a* and 14*b* under the conveying route R. A movable guide member 16 is provided above the storage box 13. This movable guide member 16 is to be moved between a closing position (indicated by a solid line in FIG. 2) and an opening position (indicated by a imaginary line in FIG. 2) by being driven by a movable guide plate driver 23 (shown in FIG. 3). The movable guide member 16 at the closing position closes an opening of the storage box 13 and guides the stencil sheet 2 along the conveying route R. The movable guide member 16 at the opening position opens the opening of the storage box 13 and allows the stencil sheet 2 to enter the storage box 13.

The second and third conveyer rollers 14*a* and 15*a* are adapted to be rotated in synchronization with each other by a conveyer motor 24. As in the case of the first conveyer rollers 12*a* and 12*b*, the pair of second conveyer rollers 14*a* and 14*b* and the pair of third conveyer rollers 15*a* and 15*b* have smaller conveying forces as compared with the platen roller 7 and the writing head 8, and the peripheral speeds thereof are set higher.

A stencil positioning sensor 17 is placed just downstream of the pair of first conveyer rollers 12*a* and 12*b* and upstream of the opening of the storage box 13. The stencil positioning sensor 17 detects the leading edge of the stencil sheet 2 using a detection point by the downstream of the stencil sheet cutter 10.

Specifically, when a predetermined time has passed after the stencil positioning sensor 17 detects the leading edge of the stencil sheet 2, the platen roller 7 is reversed in order to return the stencil sheet 2 to the upstream side, and the stencil positioning sensor 17 again detects the leading edge of the stencil sheet 2. A waiting position is determined based on the detection signal. This is to prevent the stencil positioning sensor 17 from detecting the stencil sheet 2 in a state of waiting.

In other words, the leading edge of the stencil sheet 2 returns to the upstream side and stops at the waiting position away from the stencil positioning sensor 17 by a predetermined distance.

In the stencil printing machine according to the embodiment, the following is arranged from upstream to downstream on the conveying route R in the order of: the writing head 8 which forms a perforated image on the stencil sheet 2 and the platen roller 7 which conveys the stencil sheet 2; the stencil sheet cutter 10 which cuts the stencil sheet 2, the stencil positioning sensor 7 which detects the leading edge of the stencil sheet 2; the storage box 13 which temporarily stores the stencil sheet 2; and the stencil sheet clamp section 4*a* which clamps the leading edge of the stencil sheet 2 to load the stencil sheet 2 on the printing drum 4.

The stencil sheet clamp section 4*a* is provided on an outer peripheral surface of the printing drum 4. The printing drum 4 is rotated in a direction of an arrow A shown in FIG. 2 by driving force of a drum motor 25 (shown in FIG. 3). And the printing drum 4 is able to stop at a clamp rotational position (at which the stencil sheet clamp section 4*a* shown in FIG. 2 is located substantially at the uppermost position) for clamping the leading edge of the stencil sheet 2 and at a stencil sheet cutting rotational position for cutting the stencil sheet 2.

Next, a description will be given of an operation of a controller 26 related to stencil making and loading operations.

As shown in FIG. 3, the controller 26 includes a CPU (central processing unit, not shown), a ROM (read only memory, not shown) storing programs and control data, a RAM (random access memory, not shown) as a work area, a storage unit (not shown) storing a large amount of data and programs, and the like. The controller 26 controls a writing operation of the writing head 8 based on binarized stencil-making data and controls operations of the platen motor 20, head shift driver 21, cutter driver 22, movable guide plate driver 23, conveyer motor 24, drum motor 25, and the like according to programs. Moreover, the controller 26 controls the waiting position of the stencil sheet 2 by means of a driving time period of the platen motor 20 (for example, the driving time period is measured by a timer or the like, driving pulses are measured by a pulse counter or the like) on the basis of the detection signal of the stencil positioning sensor 17.

The stencil making and loading operations of the aforementioned stencil printing machine will be described in detail with reference to FIGS. 4A to 4C and FIGS. 5A to 5C. FIGS. 4A to 4C and FIGS. 5A to 5C are schematic illustrations showing a procedure of the stencil loading operation of the stencil making unit shown in FIG. 2. FIG. 4A shows that the stencil sheet 2 is conveyed to the waiting position after the last stencil loading operation is completed, and the stencil sheet 2 is in a state of waiting. When the stencil making operation is started, the writing head 8 is shifted from the standby position to the pressure-contact position by the head shift driver 21, and the stencil sheet 2 is brought into pressure contact with the platen roller 7 by the writing head 8. The platen roller 7 is rotated by the platen motor 20, and the stencil sheet 2 is conveyed along the conveying route R. The stencil sheet 2 is thermally perforated by the writing head 8 in synchronization with the conveying, whereby a perforated image is sequentially formed on the stencil sheet 2 based on the binarized stencil making data. The stencil sheet 2 sandwiched between the writing head 8 and the platen roller 7 is being conveyed also receiving the rotating force of the pair of first conveyer rollers 12*a* and 12*b* to be conveyed downstream.

Since the movable guide member 16 is located at the closing position, the leading edge of the stencil sheet 2 is conveyed along the movable guide member 16 to the pair of second conveyer rollers 14*a* and 14*b* without being guided into the storage box 13.

Next, in FIGS. 4B and 4C, the controller 26 calculates a timing with which the leading edge of the stencil sheet 2 reaches the pair of second conveyer rollers 14*a* and 14*b* based on a driving time period T1 of the platen motor 20. After the driving time period T1, the controller 26 drives the movable guide plate driver 23 and moves the movable guide member 16 to the opening position from the closing position. When a very short time period t has passed after the movable guide member 16 is shifted to the opening position, the controller 26 stops the drive of the conveyer motor 24. The rotation of the pair of second conveyer rollers 14*a* and 14*b* is thus stopped in a state where the pair of second conveyer rollers 14*a* and 14*b* sandwich the leading edge of the stencil sheet 2.

The formation of the perforated image by the platen roller 7 and the writing head 8 is continued after the drive of the conveyer motor 24 is stopped. The stencil sheet 2 stays between the pair of second conveyer rollers 14*a* and 14*b* and the pair of first conveyer rollers 12*a* and 12*b*, and the staying stencil sheet 2 is gradually stored in the storage box 13.

When the stencil making operation is started, a stencil discharge operation for the stencil sheet 2 loaded on the printing drum 4 is performed in parallel with the aforementioned stencil making operation. After the stencil discharge operation is completed, the stencil sheet clamp section 4*a* is positioned at the clamp rotational position. The operation of the printing drum 4 involved in the stencil discharge operation is omitted in FIGS. 4A to 4C and FIGS. 5A to 5C.

Next, in FIG. 5A, the controller 26 measures a time period L1/Sp until the length of the stencil sheet 2 stored in the storage box 13 becomes equal to or longer than a conveying distance L1 which is from the waiting position to the position of the stencil sheet clamp section 4*a*. When the time period L1/Sp has passed after the stencil making was started, the conveyer motor 24 is driven, and the pair of second conveyer rollers 14*a* and 14*b* and the pair of third conveyer rollers 15*a* and 15*b* are rotated together. The leading edge of the stencil sheet 2 is thus conveyed to the stencil sheet clamp section 4*a*. The stencil sheet clamp section 4*a* then clamps the leading edge of the stencil sheet 2.

Next, in FIG. 5B, the drum motor 25 is driven earlier, by the time period (L1+L2)/Sp, than the timing of completing the stencil making operation, and the printing drum 4 is rotated from the clamp rotational position to the stencil sheet cutting rotational position. Accordingly, the stencil sheet 2 with a length of {L−(L1+L2+L3)} is loaded on the printing drum 4. If the part of the stencil sheet 2 with a length of {L−(L1+L2+L3)} is loaded on the printing drum 4, the entire stencil sheet 2 stored in the storage box 13 is loaded thereon, and there is no stencil sheet 2 which is left in the storage box 13.

With this timing, the writing head 8 is shifted to the standby position to release a stencil making pressure, and the rotation of the platen roller 7 and the first conveyer roller 12*b* is stopped. Therefore, a stencil making pressure release time period T needs to satisfy an expression T<{L−(L1+L2+L3)}(1/Sp+1 /Sh)−(L1+L1)/Sp.

Subsequently, the printing drum 4 is rotated, and part of the stencil sheet 2 with a length of L3 is loaded at the peripheral speed Sh.

Note that, when the printing drum 4 is rotated from the clamp rotational position to the stencil sheet cutting rotational position, the platen roller 7, the pair of first to third conveyer rollers 12*a*, 12*b*, 14*a*, 14*b*, 15*a*, and 15*b* may be rotated by driving the platen motor 20 and the conveyer motor 24.

Next, in FIG. 5C, the rotation of the printing drum 4 is stopped, and the stencil sheet 2 is cut with the stencil sheet cutter 10. Herein, the stencil sheet 2 is cut such that the conveying distance (L1+L2) from the stencil sheet cutter 10 to the stencil sheet clamp section 4*a* on the conveying route R is equal to a loading length between the stencil sheet cutting rotational position and the clamp rotational position of the printing drum 4 (in this embodiment, the example using a shuttle cutter as the stencil sheet cutter 10 is shown. However, if a rotary cutter is used, for example, it is possible to cut the stencil sheet 2 during the stencil loading operation and set a cutting time period Tk to zero.)

When the stencil sheet 2 is cut, the printing drum 4 is rotated again, and part of the stencil sheet 2 with a length of (L1+L2) remaining on the conveying route R is loaded thereon.

Thereafter, the stencil sheet clamp section 4*a* is again positioned at the stencil sheet clamp rotational position. If the stencil positioning sensor 17 does not detect the stencil sheet 2, the stencil loading operation is completed.

FIG. 6B shows a time chart related to the aforementioned stencil making (writing head), stencil making pressure release, conveying (rotation of platen roller) stencil loading (rotation of printing drum), cutting, and printing/printed sheet discharged operations.

Note that the stencil making, stencil making pressure release, conveying, stencil loading, cutting, and printing/stencil discharge time periods in this embodiment are the same as those of the conventional art (FIG. 6A). As for this embodiment, the timing of the stencil loading is different from the conventional art at the point that only the time period (L1+L2)/Sp is earlier than the timing of completing the stencil making operation.

Therefore, a first print time Tf2 in FIG. 6B is expressed as Tf2=Ts+T+(L1+L2+L3)/Sh+TK+Tp.

In other words, while FIG. 6B shows a shortest first print time, it also shows that the timing of starting the stencil loading can be set to: an arbitrary time between the timing earlier, by the time period (L1+L2)/Sp at the maximum, than the timing of completing the stencil making operation and the same timing as completion of the stencil making operation; and an arbitrary time between the same timing as completion of the stencil making operation and the same timing as completion of the release of the stencil making pressure as in the case of the conventional art.

In the case of FIG. 6B, the first print time can be shortened, as compared with the case of FIG. 6A, by an arbitrary time period chosen from between zero and the time period T+(L1+L2)/Sp at the maximum. Here, the first time period can be shortened by completing the stencil making operation earlier.

Moreover, as a special case, it is possible to simplify the control by starting the stencil loading simultaneously with the completion of the stencil making operation as shown in FIG. 6C. In this case, the stencil making pressure release time period T needs to satisfy an expression T<{L−(L1+L2+L3)}/Sh.

Therefore, a first print time Tf3 in FIG. 6C is expressed as Tf3=Ts+Tc+Tp.

Accordingly, as compared with FIG. 6A, the first print time in FIG. 6C can be shortened by the stencil making pressure release time period T. FIG. 6C is the same as FIGS. 6B and 6C except for the timing of starting the stencil loading.

When the stencil sheet 2 is cut with the stencil sheet cutter 10, the writing head 8 is shifted from the standby position to the pressure contact position by the writing head shift driver 21, and the stencil sheet 2 is sandwiched between the writing head 8 and the platen roller 7. Subsequently, the platen roller 7 and the pair of first conveyer rollers 12*a* and 12*b* are rotated by the platen motor 20, and the stencil sheet 2 is conveyed along the conveying route R.

When a predetermined time period has passed after the leading edge of the stencil sheet 2 is detected by the stencil positioning sensor 17, the platen roller 7 is reversed to bring the stencil sheet 2 back to the upstream side. The leading edge of the stencil sheet 2 is again detected, and the waiting position of the stencil sheet 2 is determined based on the detection signal. Then, the rotation of the platen roller 7 and the pair of first conveyer rollers 12*a* and 12*b* is stopped, and the writing head 8 is shifted to the standby position.

The leading edge of the stencil sheet 2 waits at the waiting position until instructions to start the next stencil making operation are given.

As described in the above embodiment shown in FIG. 6B, the timing of completing the stencil loading operation is made earlier by starting the stencil loading operation at an arbitrary time between the timing earlier, by the time period (L1+L2)/Sp at the maximum, than the timing of completing the stencil making operation and the same timing as completion of the stencil making operation. Accordingly, as compared with the conventional example shown in FIG. 6A, it is possible to shorten the first print time by an arbitrary time period between T and T+(L1+L2)/Sp at the maximum. Here, T and T+(L1+L2)/Sp are time periods by which the stencil loading operation is completed earlier. Moreover, the timing of completing the stencil loading operation is made earlier by starting the stencil loading operation at an arbitrary time between the same timing as completion of the stencil making operation and the same timing as completion of the release of the stencil making pressure. Thus, the first print time can be shortened by an arbitrary time period between zero and T, by which the stencil loading operation is completed earlier, at the maximum.

In addition, the first print time can be easily shortened only by changing the timing of starting the stencil making, and there is no need for hardware modifications such as modifications of the mechanical mechanism and addition of mechanism.

Furthermore, as shown in FIG. 6C, by starting the stencil loading at the timing of completing the stencil making operation, the first print time can be shortened by the time period T as compared with the conventional example shown in FIG. 6A, and the control method can be simplified. As in the case of FIG. 6B, the first print time can be easily shortened only by changing the timing of starting the stencil loading.

What is claimed is:

1. A stencil printing machine, comprising:

a conveying route along which a leading edge side of a roll stencil sheet is conveyed to a stencil sheet clamp section of a printing drum;

a writing head which forms a perforated image on the stencil sheet;

a platen roller on which the writing head is brought into pressure contact and which conveys the stencil sheet;

a stencil sheet cutter which cuts the stencil sheet;

a stencil positioning sensor which detects a leading edge of the stencil sheet;

storage means for temporarily storing the stencil sheet; and control means for controlling a timing at which the printing drum is rotated to start loading of the stencil sheet, the control means determining the timing between an earliest timing, which is earlier by a predetermined time period than a timing at which the writing head completes forming a perforated image on the stencil sheet, and a latest timing, which is a same timing as completion of release of stencil making pressure, wherein the predetermined time period is obtained by dividing a conveying distance between the stencil sheet cutter and the stencil sheet clamp section by a peripheral speed of the platen roller.

2. The stencil printing machine according to claim 1, wherein the control means controls the timing at which the printing drum is rotated to start loading of the stencil sheet such that the timing is a same timing as the timing at which the writing head completes forming a perforated image on the stencil sheet.

* * * * *